United States Patent [19]

Moyer

[11] 4,068,597

[45] Jan. 17, 1978

[54] CONVEYOR SYSTEM CONTROL CIRCUIT

[75] Inventor: Ernest P. Moyer, Frederick, Md.

[73] Assignee: American Chain & Cable Company, Inc., Bridgeport, Conn.

[21] Appl. No.: 722,352

[22] Filed: Sept. 13, 1976

[51] Int. Cl.[2] ..... G06K 7/10

[52] U.S. Cl. ..... 104/88; 198/352; 214/11 R

[58] Field of Search ..... 104/88; 214/14 R, 14 C; 198/352; 250/213 A, 551; 235/61.11 R–61.11 E; 307/311; 317/125; 340/172.5

[56] References Cited

U.S. PATENT DOCUMENTS

| | | | |
|---|---|---|---|
| 3,171,362 | 3/1965 | Noye et al. | 104/88 |
| 3,751,640 | 8/1973 | Daigle et al. | 104/88 X |
| 3,801,837 | 4/1974 | Pease et al. | 250/551 X |
| 3,958,126 | 5/1976 | Bryant | 250/551 X |

OTHER PUBLICATIONS

Grayhill, Inc., Solid State Relays, 1973, p. 1–8, 561 Hillgrove Ave., La Granee, Illinois, 60525.

Jayson, Joels, et al., Coupling circuits with light, Bell Laboratories Record, vol. 54, No. 1, 1–1976, p. 21–25.

*Primary Examiner*—Stephen G. Kunin

*Attorney, Agent, or Firm*—Barnes, Kisselle, Raisch & Choate

[57] ABSTRACT

A conveyor system wherein a traveling mechanism is moved in a predetermined path and selectively controlled in its movement including an encoder unit mounted on the mechanism and a readout unit mounted along the path and wherein the encoder unit provides a plurality of input signals and the readout unit reads the signals to actuate a control device along the path to determine the path of movement of the traveling mechanism. A control circuit is associated with said encoder and readout units and comprises a readout circuit and a logic circuit. The readout circuit includes an AND circuit having an input for receiving signals from the encoder unit and transmitting an output signal when the code on the encoder unit matches the code on the readout unit. The logic circuit has an input and an output. The output of the readout circuit is coupled to the input of the logic circuit while maintaining the readout circuit electrically isolated from the logic circuit. The output of the logic circuit is coupled to the control device along the path of the traveling mechanism while maintaining the logic circuit and the control device electrically isolated from one another.

16 Claims, 3 Drawing Figures

10
11
12
13
14
15
16
17
18
19
20
2
C

CONVEYOR SYSTEM CONTROL CIRCUIT

This invention relates to conveyor control systems and particularly systems for determining the movement and destination of load carriers such as trolleys.

BACKGROUND AND SUMMARY OF THE INVENTION

In power and free conveyor systems, carriers are movable along a free track by a powered chain or the like and are transferred to various locations in the system by track switches. It is common to provide an encoder unit on the carrier which includes a particular code arrangement of contacts, magnetic snesors, optical sensors, or other sensing devices. When the carrier with the encoder is moved past a fixed readout unit along the track and the position or code setting of the sensing devices on the encoder corresponds to the position or code of the sensing devices on the readout unit, signals are produced which are then transmitted to a readout circuit which will actuate the track switch for routing the carrier to the proper portion of the system.

Such systems are well known and are shown and described in U.S. Pat. Nos. 3,126,837, 3,140,669 and 3,171,362.

One of the problems in connection with such systems is that there sometime occur spurious signals or false signals. An additional problem is that the circuitry heretofore used has limited the versatility of the system in terms of optional operation such as for recirculating the carriers where portions of the system are filled or shutting down the system. The present invention is intended to obviate or minimize these problems.

The invention includes a logic circuit that is electrically isolated from spurious and false signals; wherein the logic circuitry is separate from the readout portion of the circuitry; wherein digital logic is utilized to improve the versatility of the system; and wherein there is time filtering of the input signals to the logic circuit to minimize false signals.

DESCRIPTION

Figures 1, 2:
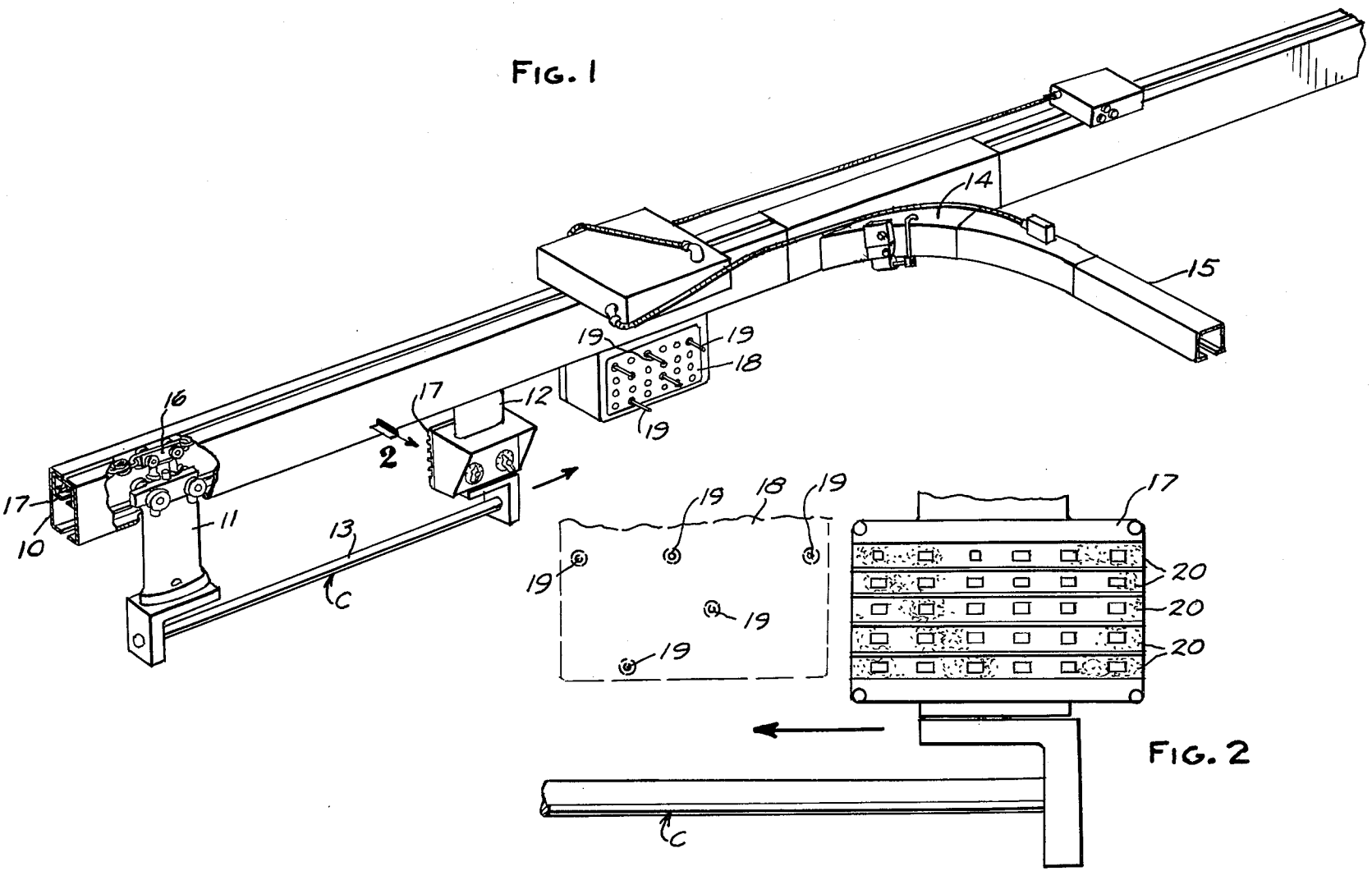
FIG. 1 is a part sectional perspective view of a portion of a power and free conveyor system embodying the invention.
FIG. 2 is a fragmentary view taken in the direction of the arrow 2 in FIG. 1.

In a typical traveling system such as a power and free conveyor system such as shown in the aforementioned U.S. Pat. Nos. 3,126,837, 3,140,669 and 3,171,362, a free or carrier track 10 supports a plurality of carriers C, each of which has wheeled trolleys 11, 12 connected by a load bar 13. Switches 14 are provided along the track 10 for diverting the carriers C to a branch track 15. The carriers C are moved along the main track 10 by a conveyor chain 16 supported in a track 17. The chain is powered by a separate drive (not shown). An encoder unit 17 is mounted on the carrier C. When the carrier C moves along the track, it passes by a readout unit 18 having a plurality of sensors, herein shown as contact brushes 19. A card 20 is mounted on the encoder unit 17 to expose selective portions of electrical contacts. The card 20 is selected to produce a predetermined code on the encoder unit and when the code on the encoder unit matches the placement of the contacts 19 on the readout unit, signals are produced to actuate the switch 14 and divert the carrier along the track 15.

Figure 3:
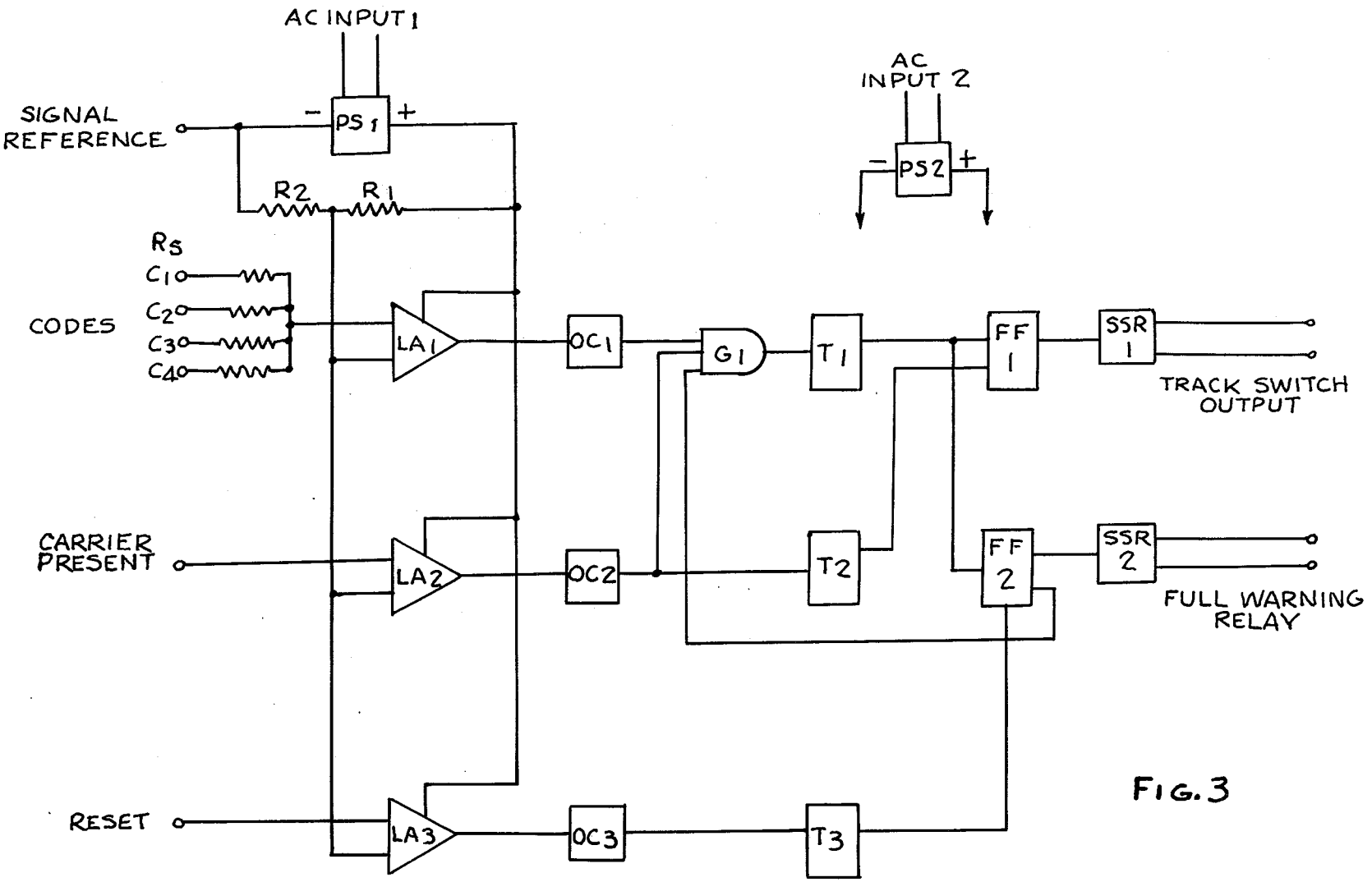
FIG. 3 is a partly diagrammatic electrical control circuit for the system.

In accordance with the invention, the control circuit as shown in FIG. 3 comprises a readout circuit and a logic circuit.

The readout circuit functions to read the code of the encoder unit and if it matches that of the readout unit, transmits output signals to the logic circuit which, in turn, operates the control device such as track switch 14. In the example shown, the encoder unit produces a reference signal identifying the fact that the carrier is present at the particular instant of time at the readout unit and a plurality of signals in a particular physical arrangement forming the code, herein shown as four signals $C_1$ through $C_4$.

More specifically, the readout circuit includes a power supply PS1, for supplying power to input buffers comprising operational amplifiers LA-1, LA-2, LA-3. The operational amplifiers function as voltage threshold comparators. Comparator LA-2 senses the presence or absence of the carrier while comparator LA-1 senses the presence or absence of four simultaneously externally originating signals in the code unit of the carrier. Comparator LA-3 senses a circuit reset signal.

The readout circuit and logic circuit are optically but not electrically coupled to one another through optical couplers OC-1, OC-2 and OC-3.

All three buffers LA-1, LA-2, LA-3 are biased at a predetermined voltage on a reference input terminal through the voltage divider $R_1$ and $R_2$.

If the voltage on the other input terminal to the comparator exceeds this reference voltage, the output from the circuit switches from logic high to logic low, causing the current into the optical couplers OC-1 through OC-3 to decrease below the activation level of the coupler.

For comparator LA-1 the input voltage threshold can be attained only if all input circuits are active. This is accomplished through the summing network of four resistors $R_s$.

Simultaneous recognition of four code signals through comparator LA-1 and optical coupler OC-1 produces a Code-Read signal output from the readout circuit to Gate $G_1$ of the logic circuit. Recognition of a Carrier Present signal through comparator LA-2 and optical coupler OC-2 produces a high on Gate $G_1$ and timing circuit $T_2$. A reset signal through comparator LA-3 and optical coupler OC-3 activates timing circuit T-3 to produce a reset signal to flip-flop FF-2. If FF-2 has been reset, a high output from the flip-flop to Gate G1 permits the carrier present and code signals to activate timing circuit T-1.

The timing circuits are designed to smooth erratic signals from the input and to produce delays such that the two inputs to flip-flop FF-1 arrive in a non-coincident manner to produce correct toggling of the flip-flop. The Carrier Present signal arrives later than the Code signal to toggle the flip-flop active. If the Carrier Present signal arrives without a Code signal, the flip-flop is not toggled, or is toggled to the initial state if toggled active on the preceding operation. When toggled, FF-1 operates the track switch through SSR-1 to divert a carrier. When not toggled, FF-1 does not operate the track switch.

Output of timing circuit T-1 also toggles flip-flop FF-2 for any Code signal not blocked by the feedback line from the output of FF-2 to Gate G1. Once operated FF-2 blocks all further Code signals until reset by a signal from T-3. This prohibits the diversion of carriers to the branch line unless the line is clear to accept another carrier.

The outputs from FF-1 and FF-2 pass through optical couplers in the Solid State Relays SSR-1 and SSR-2.

Among the features of the invention are the following:

1. Optical couplers are used on all input signals and optically coupled solid state switches are used on all outputs to isolate the logic circuit from system ground. The brush contact technique uses system ground as the common reference point. With optical isolation this ground is maintained separate from the internal logic ground. This provides much greater attenuation of spurious signals floating on the system ground.

2. Operational amplifiers are used to obtain high input impedance in order to sense with high signal source resistance. Also, this permits the ANDing of Code-Read signals at the input rather than in the logic circuitry.

3. Digital logic is used to provide versatility in optional logic recognition of several conditions.

4. Time filtering of input signals is provided by single-shot circuits with timing components chosen to accommodate different system velocities, time of contact on the Code-Read device, differences in contact initiation, erratic behavior of brush contacts, other sensing devices, and so on.

5. Two separate power sources, PS1 for the readout circuit and PS2 for the logic circuit, provide additional isolation of the two circuits.

I claim:

1. In a system wherein a traveling mechanism is moved in a predetermined path and selectively controlled in its movement including an encoder unit mounted on the mechanism and a readout unit mounted along the path and wherein the encoder unit provides a code comprising a plurality of input signals and the readout unit reads the signals to actuate a control device along the path to determine the path of movement of the traveling mechanism, the improvement comprising a control circuit associated with said encoder unit and comprising a readout circuit and a logic circuit, said readout circuit including an AND circuit having an input for receiving signals from the encoder unit and transmitting an output signal when the code on the encoder unit matches the code on the readout unit, said logic circuit having an input and an output, means for coupling the output of said readout circuit and the input of the logic circuit while maintaining the readout circuit electrically isolated from the logic circuit, and means for coupling the output of the logic circuit and the control device along the path of the traveling mechanism while maintaining the logic circuit and the control device electrically isolated from one another, said readout circuit comprising a plurality of input buffers for sensing the presence or absence of an externally originating signal from said encoder unit and for sensing the presence or absence of simultaneous code signals from the encoder unit.

2. The combination set forth in claim 1 wherein said input buffers comprise voltage threshold comparators.

3. The combination set forth in claim 2 wherein said voltage threshold comparators comprise operational amplifiers.

4. The combination set forth in claim 1 wherein said means coupling the outputs of said readout circuit with the inputs of said logic circuit comprises optical couplers.

5. The combination set forth in claim 1 wherein said logic circuit comprises a digital circuit.

6. The combination set forth in claim 1 wherein said means for coupling the output of said logic circuit with said control device comprises an optically coupled solid state switch.

7. The combination set forth in claim 1 wherein said logic circuit includes means for time filtering the input signals thereto.

8. The combination set forth in claim 7 wherein said time filtering means comprises single-shot circuits.

9. In a system wherein a traveling carrier mechanism is moved in a track and selectively controlled in its movement including an encoder unit mounted on the mechanism and a readout unit mounted along the path and wherein the encoder unit provides a code comprising a pluraity of input signals and the readout unit along the track reads the signals to actuate a track switch and determine the path of movement of the traveling carrier mechanism, the improvement comprising a control circuit associated with said encoder unit and comprising a readout circuit and a logic circuit, said readout circuit including an AND circuit having an input for receiving signals from the encoder unit and transmitting an output signal when the code on the encoder unit matches the code on the readout unit, said logic circuit having an input and an output, means for coupling the output of said readout circuit and the input of the logic circuit while maintaining the readout circuit electrically isolated from the logic circuit, and means for coupling the output of the logic circuit and the track switch along the path of the traveling carrier mechanism while maintaining the logic circuit and the track switch electrically isolated from one another, said readout circuit comprising a plurality of input buffers for sensing the presence or absence of an externally originating signal from said encoder unit and for sensing the presence or absence of simultaneous code signals from the encoder unit.

10. The combination set forth in claim 9 wherein said input buffers comprise voltage threshold comparators.

11. The combination set forth in claim 10 wherein said voltage threshold comparators comprise operational amplifiers.

12. The combination set forth in claim 9 wherein said means for coupling the outputs of said readout circuit with the inputs of said logic circuit comprises optical couplers.

13. The combination set forth in claim 9 wherein said logic circuit comprises a digital circuit.

14. The combination set forth in claim 9 wherein said means for coupling the output of said logic circuit with said control device comprises an optically coupled solid state switch.

15. The combination set forth in claim 9 wherein said logic circuit includes means for time filtering the input signals thereto.

16. The combination set forth in claim 15 wherein said time filtering means comprises single-shot circuits.

* * * * *